US006030321A

United States Patent [19]

Fuentes

[11] Patent Number: 6,030,321

[45] **Date of Patent: *Feb. 29, 2000**

[54] KICKING EXERCISER FOR MARTIAL ARTS

[76] Inventor: Joe A. Fuentes, 600 S. Pine, Roswell, N.Mex. 88201

[ * ] Notice: This patent is subject to a terminal disclaimer.

[21] Appl. No.: 08/410,770

[22] Filed: Mar. 27, 1995

[51] Int. Cl.[7] ..... A63B 21/02

[52] U.S. Cl. ..... 482/83; 482/74

[58] Field of Search ..... 482/74, 79, 125, 482/124, 114–120, 83, 127, 148, 97

[56] References Cited

U.S. PATENT DOCUMENTS

| | | | |
|---|---|---|---|
| 196,435 | 10/1877 | Clifford | 482/127 |
| 3,749,400 | 7/1973 | Stoffel | 272/83 R |
| 3,764,132 | 10/1973 | Hepburn | 482/116 |
| 4,111,415 | 9/1978 | Reitano | 272/94 |
| 4,235,439 | 11/1980 | De Donno | 482/116 |
| 4,522,392 | 6/1985 | Torii | 272/142 |
| 4,948,119 | 8/1990 | Robertson | 482/116 |
| 4,964,629 | 10/1990 | Wright | 272/76 |
| 4,968,028 | 11/1990 | Wehrell | 482/124 |
| 5,133,545 | 7/1992 | Moschetti et al. | 482/115 |
| 5,176,599 | 1/1993 | Beliakov | 482/91 |
| 5,447,484 | 9/1995 | Chandler | 482/52 |

FOREIGN PATENT DOCUMENTS

| | | | |
|---|---|---|---|
| 562038 | 5/1975 | Switzerland | 482/133 |

*Primary Examiner*—Jerome Donnelly

[57] ABSTRACT

The invention is an exercise apparatus for athletes who engage is sports that require a strong, quick kick. A pair of cables extend from a platform and contain cuffs for strapping to the athletes ankle. Below the platform is a mechanism, including a reel for storing each cable, mounted on a common shaft, through a one way clutch. Each reel is connected to a recoil spring which retracts the cable when any force withdrawing the cable is relaxed. An adjustable friction brake is attached to the common shaft for controlling the force required to withdraw the cable from the stored condition.

2 Claims, 3 Drawing Sheets

KICKING EXERCISER FOR MARTIAL ARTS

BACKGROUND OF THE INVENTION

1. Field of the Invention

This invention relates generally to exercise equipment and more particularly to an exercise apparatus that will condition and strengthen the legs of a person engaged in the martial arts.

2. Description of the Prior Art

Some sports involve using the feet for kicking as well as the hands for competitive engagement. Two of those sports include Kickboxing and Karate. The object is to down your opponent by blows with the feet as well as the hands. The competitive edge in such a sport is found in speed and strength. The development of a good kick takes years of practice, much of it the form of repetitive kicking exercises. Quicker and stronger kicks can be developed with resistance, that is working the muscles while actually throwing the kick. Currently, some athletes train for kicking using strap on ankle weights for resistance, which is superior to kicking the air or punching bag in so called impact training which tends to develop only certain muscles and leaves other undeveloped related muscles. A decided disadvantage to the ankle weights is when the user "throws" a kick, the weight tends to stretch the leg which is already at the maximum extension and can cause injury. There is a need for a kick exercising apparatus that will condition all the muscles in the lower body that are used in kick related sports without the threat of injury.

Examples of training equipment that could be used to strengthen and rehabilitate the legs of an individual include those shown in Stoffel U.S. Pat. No. 3,749,400 issued Jul. 31, 1973 for a spring type leg exercise device. U.S. Pat. No. 4,111,415 issued Sep. 5, 1978 to Reitano, who discloses a multi-use exercising apparatus to aid in the practice of karate. U.S. Pat. No. 4,522,392 issued Jun. 11, 1985 to Torii shows a leg exercise device that utilizes foot boards with a spring resistance. A was issued Jan. 5, 1993, U.S. Pat No. 5,176,599 to Beliakov for an apparatus for developing arm or leg blows. The device utilizes a magnetic brake to provide resistance to the release of the cord which engages the wrist of the athlete.

The devices disclosed reflect the state of the art but fail to anticipate the invention disclose herein.

SUMMARY OF THE INVENTION

The invention is characterized by a pair of cables that extend from a housing upon which the athlete stands. The user wears an ankle cuff with a connecting ring for engaging a snap connector on the end of each cable. Within the housing is a rotatable shaft that contains an adjustable friction brake located mid shaft. At each end of the shaft is a spring biased reel containing the cable that projects from the housing. As the cable is withdrawn from the housing, by the athlete, against the resistance of the friction brake, a coil spring located next to the reel is tightened. Through the action of a free wheeling clutch, located in the reel, the cable retracts and rewinds when the withdrawing force is removed.

Each cable operates independently of the other so that cable restraints may be worn on both ankles although only one leg is kicking at any given moment. The friction brake is adjustable and as the legs of the athlete become stronger the friction on the shaft may be increased allowing the user to develop his own strength and speed program.

It is therefore an object of the invention to provide a new and improved kick exercising apparatus.

It is another object of the invention to provide a new and improved kick exercising apparatus that will strengthen leg muscles.

It is a further object of the invention to provide a new and improved kick exercising apparatus that will help prevent injuries to the legs and lower body.

It is still another object of the invention to provide a new and improved kick exercising apparatus that continuous interval kick exercising with both legs.

It is still a further object of the invention to provide a new and improved kick exercising apparatus which is of a durable and reliable construction.

It is another object of the invention to provide a new and improved kick exercising apparatus which may be easily and efficiently manufactured and marketed.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
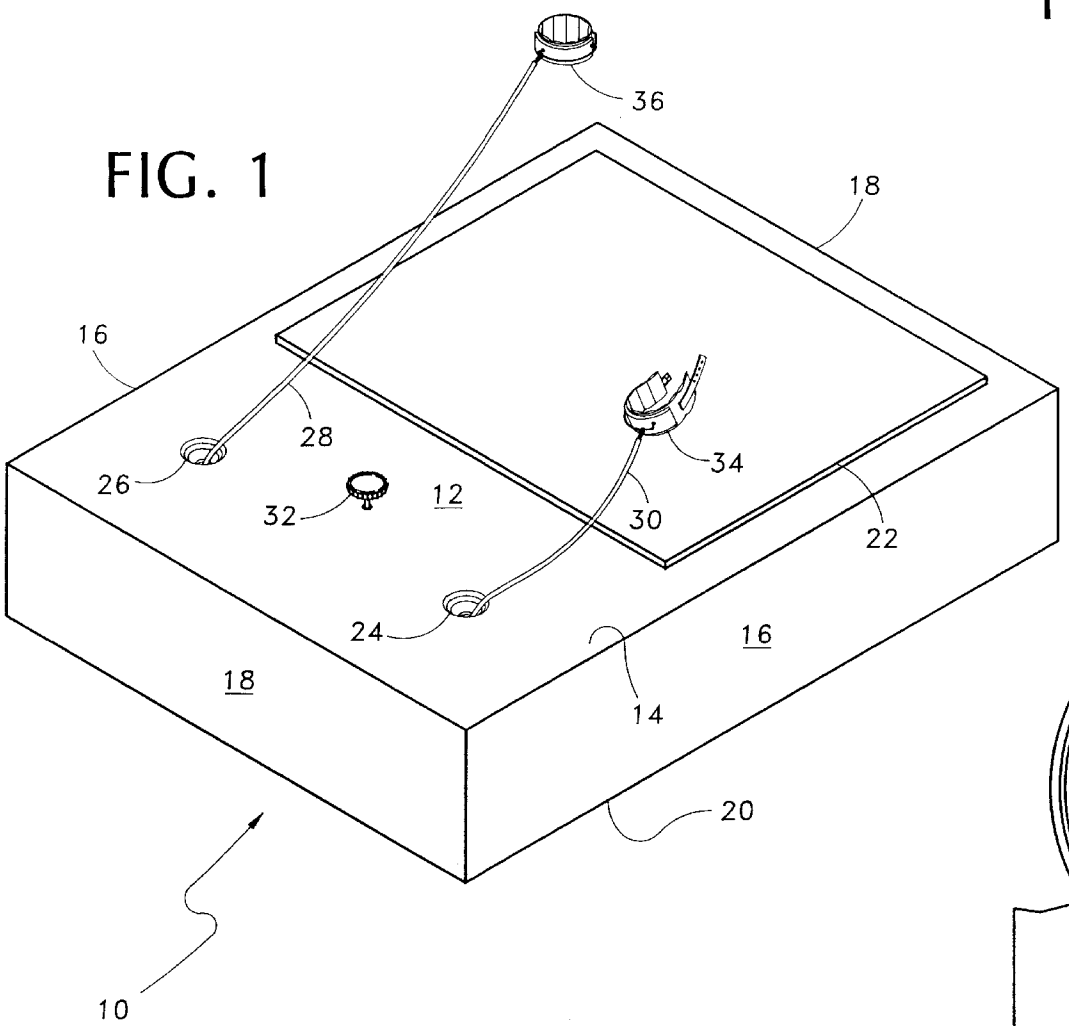
FIG. 1 is a perspective view of the invention.

Referring now to FIG. 1, the invention is shown generally at 10 and consists of a housing 12 with a top wall 14 and parallel upstanding side walls 16 and parallel upstanding end walls 18. A bottom wall 20 is a flat planar surface parallel to top wall 14. The top surface includes an area 22 for the user to stand while exercising. The area may be covered with a surface material that inhibits slipping in that most kicking exercise is performed with the feet uncovered and perspiration on a slick surface is conducive to slipping and falling. Apertures 24 and 26 through top wall 14 allow cables extend and retract from the control mechanism located within the housing 12. An adjustment knob 32 is located between apertures 24 and 26 and is connected to the friction brake located in the housing. Cables 28 and 30 have, removably connected to their ends, ankle straps 34,36 which are worn by the user during the kicking exercise.

Figure 2:
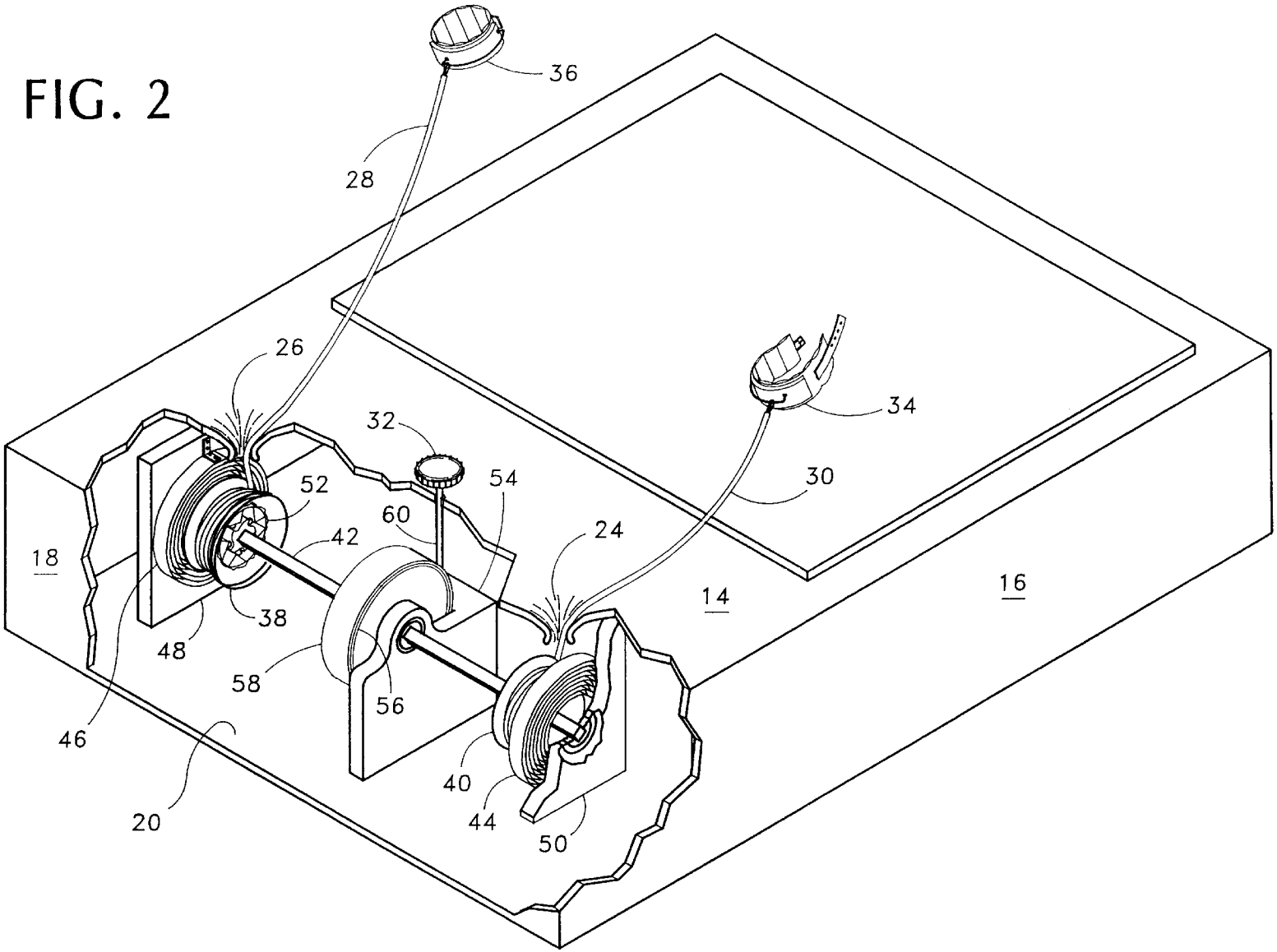
FIG. 2 is a perspective view of the invention cut away showing the apparatus of operation.
Figure 3:
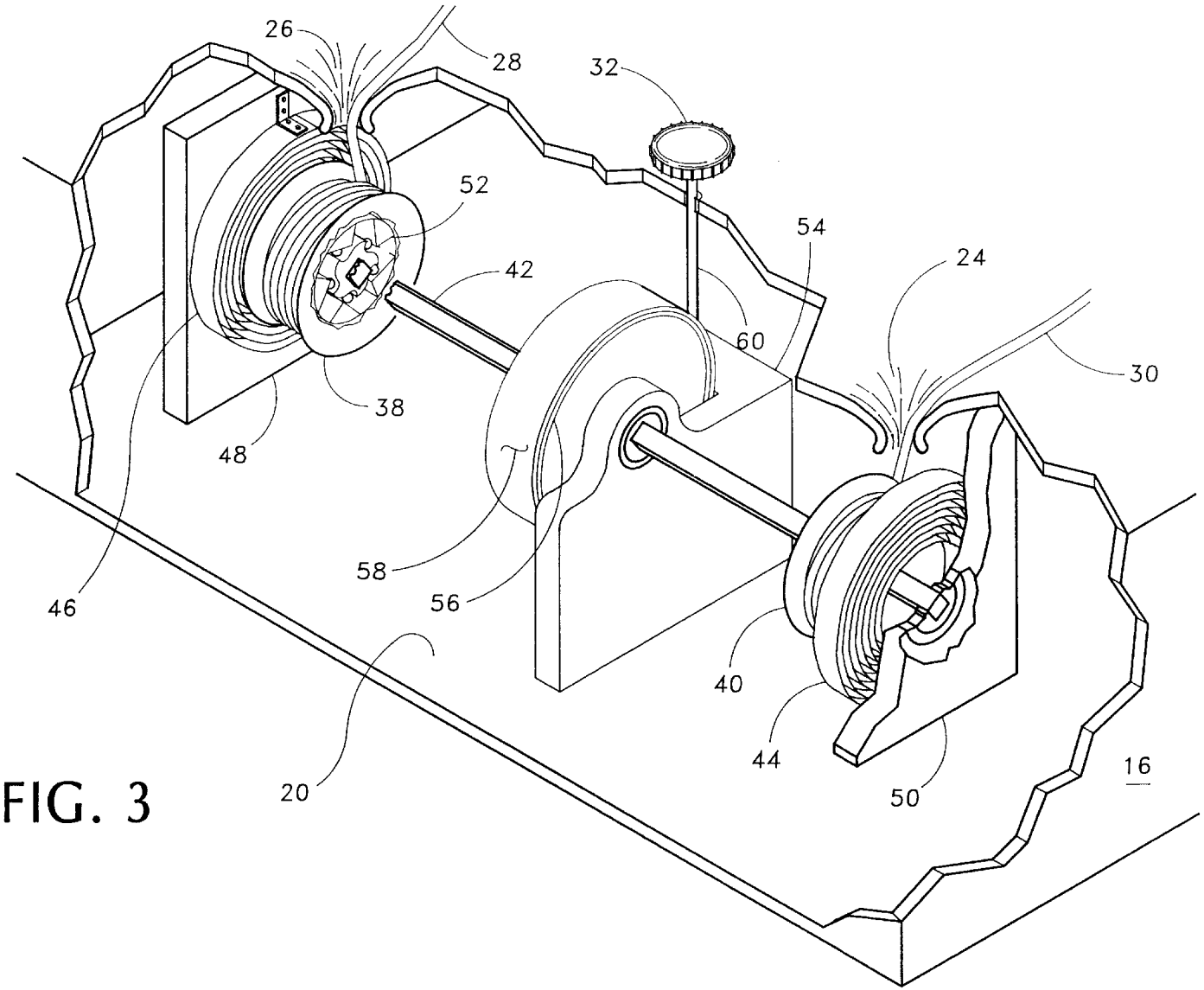
FIG. 3 is an enlarged view of the invention.

Concerning FIGS. 2 and 3, cables 28 and 30 are stored on reels 38 and 40 which are positioned on square shaft 42. Recoil springs 44 and 46 are connected between each reel and the end support members 48 and 50. Between the square shaft and each reel is a free wheeling clutch 52 which causes the reel to engage and turn the square shaft when the cable is payed out, off the reel. Simultaneously the reel is winding and tightening the recoil spring whereby when the cable is extended to the limit of the athletes use and relaxes his kick the spring will draw the cable back and rewind. During the rewind operation the square shaft is disengaged from the reel and remains stationary.

The square shaft is supported by bearing in end supports 48 and 50 as well as center support 54. Adjacent the support 54 is a wheel 56 which is mounted on the square shaft, having a flat circumferential surface on which rides on a friction brake surface 58. The extent of the braking force applied to the wheel is controlled by adjustment knob 32 acting through shaft 60 on the brake adjustment mechanism.

Figure 4:
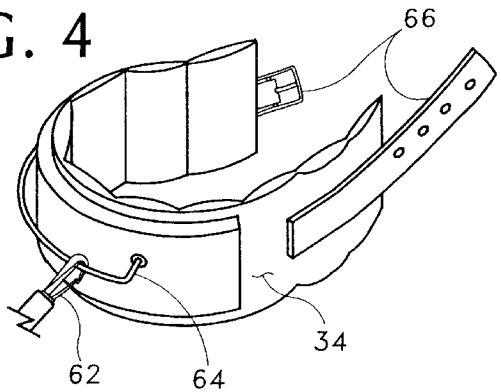
FIG. 4 is a detailed view of the ankle strap in connection with the cable.

FIG. 4 shows the ankle strap and connection with the cable. The ankle strap 34 is connected to the cable by a snap hook 62 which attaches to a ring 64 attached to the ankle strap. The strap, which may be padded for comfort, includes a buckle arrangement 66 for bringing the two ends together and securing them around the ankle of the user.

Figure 5:
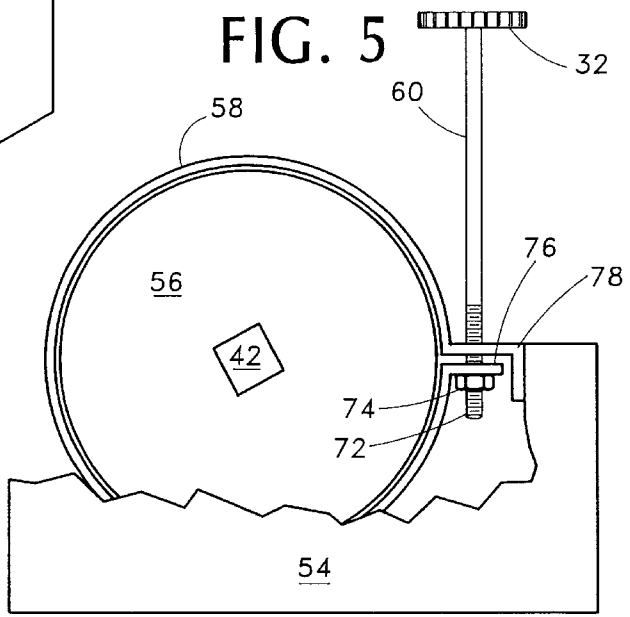
FIG. 5 is a detail view of the friction brake.

FIG. 5 shows the friction brake mechanism, with the square shaft 42 in the center of the pulley 56 and in circumferential engagement with the friction brake 58. Shaft 60 is threaded at one end 72 and engages the nut 74 which will cause the lip 76 of the friction brake to draw up against the lip 78 of the brake and increase the friction on the wheel 56. The lip 78 is securely connected to center support 54.

In operation, as the cable is withdrawn from the housing and unwinds from the reel, the clutch engages the square shaft which turns against the resistive force of the friction brake. Some small resistive force is included from the recoil spring which is tightened for the particular reel being unwound. When the force on the cable is relaxed the clutch disengages the square shaft and recoil spring takes over and rewinds preparing for the next extension. As a general rule only one reel is unwound at a time however there is nothing in the mechanism of the invention to prevent both cables from extending simultaneously.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. An exercise machine for developing and strengthening the lower torso and leg muscles of athletes comprising:

a housing having:

a top wall; and a bottom wall:

two pairs of parallel upstanding walls connecting the top wall to the bottom wall;

a surface on the top wall for the athlete to stand on;

a first cable and a second cable extending from the housing;

a first extending end on the first cable;

a second extending end on the second cable;

a first detachable, padded ankle strap;

a second detachable, padded ankle strap;

a first slip ring attached to the first detachable, padded ankle strap;

a second slip ring attached to the second detachable, padded ankle strap;

a first snap hook connected to the first extending end;

a second snap hook connected to the second extending end;

the first snap hook releasably connected to the first slip ring;

the second snap hook releasably connected to the second slip ring;

means, within the housing, for releasably storing each cable comprising at least two reels mounted on a common square shaft;

means for controlling the force required to withdraw stored cable from the housing comprising an adjustable friction brake mounted on the common square shaft; and means for retracting cable to a stored condition, when a withdrawing force is relaxed, comprising a recoil spring operatively connected to the square shaft through a free wheeling clutch mechanism.

2. An exercise machine for developing and strengthening the lower torso and leg muscles according to claim 1 wherein the ankle straps are affixed to the ankles of the athlete by a surrounding the ankle and connecting ends of the straps with a buckle connector.

* * * * *